US009002246B2

(12) United States Patent
Deguchi et al.

(10) Patent No.: US 9,002,246 B2
(45) Date of Patent: Apr. 7, 2015

(54) TRANSFER DEVICE AND IMAGE FORMING APPARATUS FOR INCREASING RELATIVE POSITIONAL ACCURACY BETWEEN A TRANSFER MEMBER AND A WOUND MEMBER

(71) Applicant: Fuji Xerox Co., Ltd., Minato-ku, Tokyo (JP)

(72) Inventors: Koji Deguchi, Kanagawa (JP); Akihiro Ouchi, Kanagawa (JP); Hiroaki Yagi, Kanagawa (JP); Arichika Tanaka, Kanagawa (JP); Koichi Sato, Kanagawa (JP); Kazuyuki Yagata, Kanagawa (JP); Hibiki Sasaki, Kanagawa (JP); Kaoru Matsushita, Kanagawa (JP); Yuichi Fujisawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/912,914

(22) Filed: Jun. 7, 2013

(65) Prior Publication Data

US 2014/0112690 A1 Apr. 24, 2014

(30) Foreign Application Priority Data

Oct. 22, 2012 (JP) ..... 2012-232660

(51) Int. Cl.
*G03G 15/16* (2006.01)
*G03G 15/01* (2006.01)

(52) U.S. Cl.
CPC ..... *G03G 15/161* (2013.01); *G03G 15/0136* (2013.01)

(58) Field of Classification Search
USPC ..... 399/313, 318, 307, 315, 66
See application file for complete search history.

(56) References Cited

U.S. PATENT DOCUMENTS

| | | | | |
|---|---|---|---|---|
| 5,374,982 | A * | 12/1994 | Boockkholdt | 399/318 |
| 5,633,703 | A * | 5/1997 | Takenouchi et al. | 399/315 |
| 5,799,232 | A * | 8/1998 | Tompkins et al. | 399/167 |
| 6,009,298 | A * | 12/1999 | Sakamaki et al. | 399/318 |
| 6,343,203 | B1 * | 1/2002 | Pang | 399/307 |
| 2010/0080631 | A1 * | 4/2010 | Ogiyama et al. | 399/308 |
| 2012/0148300 | A1 * | 6/2012 | Katoh et al. | 399/121 |
| 2013/0287420 | A1 * | 10/2013 | Taoka, Keitaro | 399/66 |

FOREIGN PATENT DOCUMENTS

| | | |
|---|---|---|
| JP | 2003-131494 A | 5/2003 |
| JP | 2007-212982 A | 8/2007 |
| JP | 2010-019964 A | 1/2010 |

* cited by examiner

*Primary Examiner* — Quana M Grainger
(74) *Attorney, Agent, or Firm* — Sughrue Mion, PLLC

(57) ABSTRACT

A transfer device includes a first support member that supports a wound member, an endless transferred body being wound around the wound member; a second support member that supports a transfer member, the transfer member and the wound member pinching the transferred body and a recording medium, the transfer member causing a developer image on the transferred body to be transferred onto the recording medium; a coupling portion that couples the second support member to the first support member so that an angle of the second support member is changeable relative to the first support member; and an urging portion that is provided at the first support member and urges the second support member in a direction in which the transfer member presses the wound member.

7 Claims, 10 Drawing Sheets

TRANSFER DEVICE AND IMAGE FORMING APPARATUS FOR INCREASING RELATIVE POSITIONAL ACCURACY BETWEEN A TRANSFER MEMBER AND A WOUND MEMBER

CROSS-REFERENCE TO RELATED APPLICATIONS

This application is based on and claims priority under 35 USC 119 from Japanese Patent Application No. 2012-232660 filed Oct. 22, 2012.

BACKGROUND

The present invention relates to a transfer device and an image forming apparatus.

SUMMARY

According to an aspect of the invention, there is provided a transfer device including a first support member that supports a wound member, an endless transferred body being wound around the wound member; a second support member that supports a transfer member, the transfer member and the wound member pinching the transferred body and a recording medium, the transfer member causing a developer image on the transferred body to be transferred onto the recording medium; a coupling portion that couples the second support member to the first support member so that an angle of the second support member is changeable relative to the first support member; and an urging portion that is provided at the first support member and urges the second support member in a direction in which the transfer member presses the wound member.

BRIEF DESCRIPTION OF THE DRAWINGS

Exemplary embodiments of the present invention will be described in detail based on the following figures, wherein.

DETAILED DESCRIPTION

First Embodiment

Examples of a transfer device and an image forming apparatus according to a first exemplary embodiment of the invention are described.

General Configuration

Figure 1:
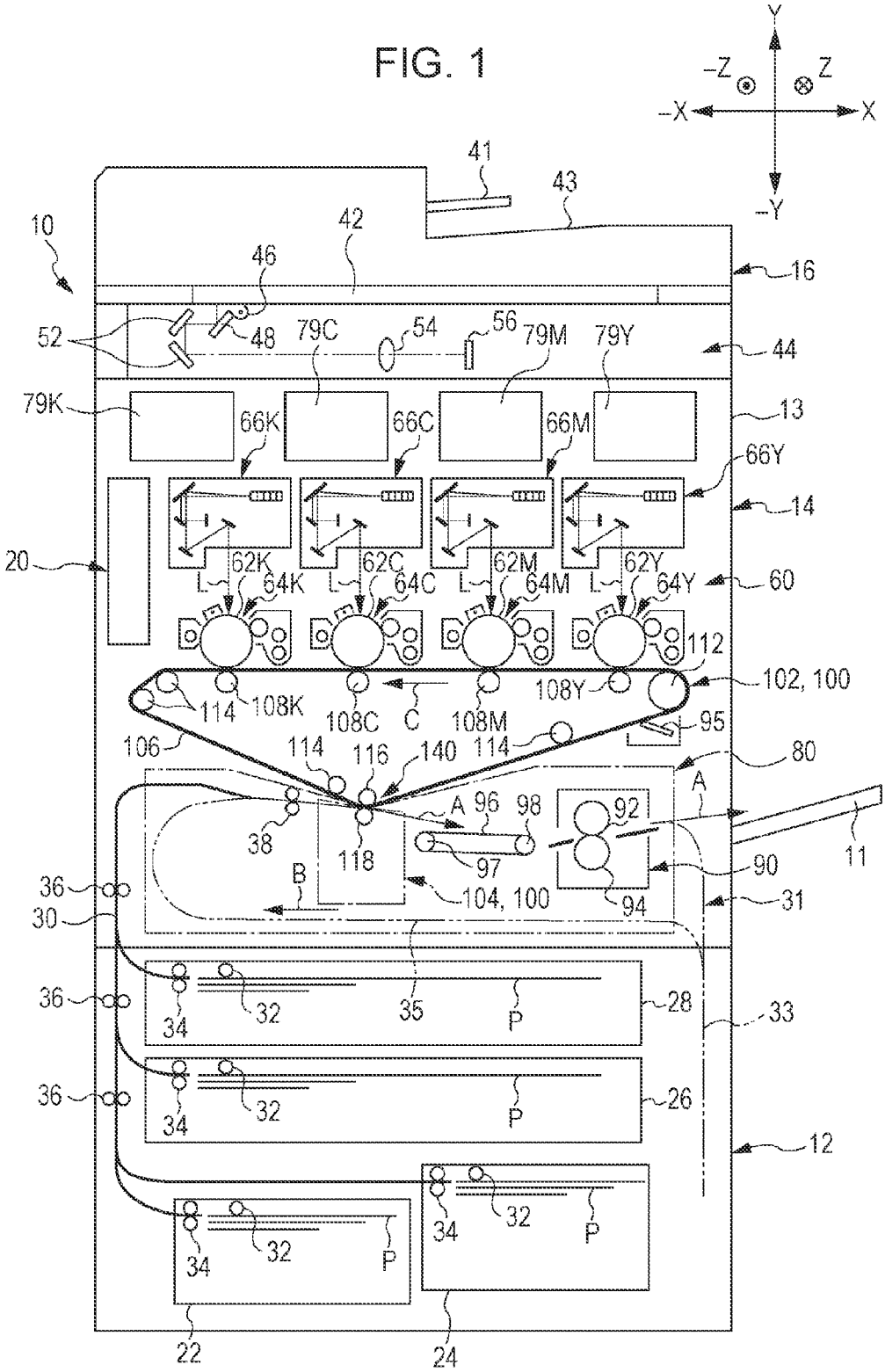
FIG. 1 is a general configuration diagram of an image forming apparatus according to a first exemplary embodiment.

FIG. 1 illustrates an image forming apparatus 10 as an example of the first exemplary embodiment. The image forming apparatus 10 includes a paper housing section 12, a main operation section 14, a document reading section 16, and a controller 20, arranged from a lower side to an upper side in the up-down direction (the Y direction). The paper housing section 12 houses recording paper P as an example of a recording medium. The main operation section 14 is provided above the paper housing section 12 and performs image formation on the recording paper P that is fed form the paper housing section 12. The document reading section 16 is provided above the main operation section 14 and reads a document (not shown). The controller 20 is provided in the main operation section 14 and controls operations of the respective units of the image forming apparatus 10.

In the figures, a symbol in which a cross is illustrated in a circle represents an arrow directed from a near side toward a deep side, and a symbol in which a dot is illustrated in a circle represents an arrow directed from the deep side to the near side. Also, in a front view of the image forming apparatus 10 from a position at which a user (not shown) stands, the X direction corresponds to the right direction, the −X direction corresponds to the left direction, the Y direction corresponds to the upper direction, the −Y direction corresponds to the lower direction, the Z direction corresponds to the direction toward the deep side and the −Z direction corresponds to a direction toward the near side.

The paper housing section 12 includes a first housing portion 22, a second housing portion 24, a third housing portion 26, and a fourth housing portion 28, which may house sheets of recording paper P with different sizes. The first housing portion 22, the second housing portion 24, the third housing portion 26, and the fourth housing portion 28 each have a sending roller 32 that sends recording paper P housed in the corresponding housing portion one by one, and a transport roller 34 that transports the sent recording paper P to a transport path 30 that is provided in the image forming apparatus 10.

Also, plural transport rollers 36 are provided in the transport path 30 at positions located downstream of the transport roller 34. The transport rollers 36 transport the sheets of recording paper P one by one. Further, a positioning roller 38 is provided in the transport path 30 at a position located downstream of the transport rollers 36 in a transport direction of the recording paper P. The positioning roller 38 performs positioning for image transfer by temporarily stopping the recording paper P and sending the recording paper P at a predetermined timing to a second transfer position (described later).

In a front view of the image forming apparatus 10, an upstream portion of the transport path 30 is provided in a linear shape toward the arrow Y direction, and extends from the −X side of the paper housing section 12 to a lower portion at the −X side of the main operation section 14. Also, a downstream portion of the transport path 30 extends from the lower portion at the −X side of the main operation section 14 to a paper output portion 11 provided at a side surface at the X side of the main operation section 14. Further, a duplex transport path 31 is connected to the transport path 30. In the duplex transport path 31, the recording paper P is transported and reversed to perform image formation on both surfaces of the recording paper P. The transport direction of the recording paper P when the duplex transport is not performed is indicated by arrow A.

In a front view of the image forming apparatus 10, the duplex transport path 31 includes a reverse portion 33 and a transport portion 35. The reverse portion 33 extends from a lower portion at the X side of the main operation section 14 to the X side of the paper housing section 12, in a linear shape toward the arrow Y direction. The trailing edge of the recording paper P transported to the reverse portion 33 enters the transport portion 35, and the transport portion 35 transports the recording paper P toward the −X side in the drawing (indicated by arrow B). A downstream end of the transport portion 35 is connected to a position of the transport path 30 located upstream of the positioning roller 38 through a guide member (not shown). Although not illustrated in FIG. 1, plural transport rollers are provided in the reverse portion 33 and the transport portion 35 at intervals. Also, a switch member that performs switching between the transport path 30 and the duplex transport path 31, and a backward-transport preventing member that prevents backward transport of the recording paper P from the reverse portion 33 to the transport path 30 are not shown.

The document reading section 16 includes a document tray 41 on which plural documents (not shown) may be placed, a platen glass 42 on which a single document may be placed, a document reading device 44 that reads the document placed on the platen glass 42, and a document output portion 43 to which the read document is output.

The document reading device 44 includes a light irradiation unit 46 that irradiates the document placed on the platen glass 42 with light; a single full-rate mirror 48 and two half-rate mirrors 52 that reflect reflection light, which is emitted on the document by the light irradiation unit 46 and is reflected from the document, and fold the light in a direction parallel to the platen glass 42; an imaging lens 54 on which the reflection light folded by the full-rate mirror 48 and the half-rate mirrors 52 is incident; and a photoelectric conversion element 56 that converts the reflection light imaged by the imaging lens 54 into an electric signal.

An image processing device (not shown) performs image processing on the electric signal converted by the photoelectric conversion element 56, and the processed signal is used for image formation. The full-rate mirror 48 moves along the platen glass 42 at full rate, and the half-rate mirrors 52 move along the platen glass 42 at half rate. The imaging lens 54 and the photoelectric conversion element 56 are fixed.

The main operation section 14 includes an image forming device 60, a drawer unit 80, and a fixing device 90 in an apparatus body 13 that is formed of plural frames. The image forming device 60 is an example of a developer image forming unit that forms a toner image (a developer image) on the recording paper P. The drawer unit 80 may be mounted in the apparatus body 13 in the Z direction or may be pulled out from the apparatus body 13 in the −Z direction. The fixing device 90 fixes the toner image on the recording paper P formed by the image forming device 60.

The image forming device 60 includes image forming units 64K, 64C, 64M, and 64Y, exposure units 66K, 66C, 66M, and 66Y, and a transfer unit 100. The image forming units 64K, 64C, 64M, and 64Y have photoconductors 62K, 62C, 62M, and 62Y respectively provided for toners of black (K), cyan (C), magenta (M), and yellow (Y) contained in a developer G (see FIG. 2, described later). The exposure units 66K, 66C, 66M, and 66Y emit light beams L to outer peripheral surfaces of the photoconductors 62K, 62C, 62M, and 62Y to perform exposure with light. The transfer unit 100 is an example of a transfer device that transfers images formed by the image forming units 64K, 64C, 64M, and 64Y onto the recording paper P. In the following description, if Y, M, C, and K have to be distinguished from each other, a component is described with either of characters Y, M, C, and K following a reference number; however, if components have similar configurations and Y, M, C, and K do not have to be distinguished from each other, the character Y, M, C, or K is omitted.

The exposure unit 66 performs scanning with a light beam emitted from a light source (not shown) by using a rotational polygon mirror (polygon mirror, no reference sign assigned), reflects the light beam by plural optical parts (not shown) including a reflection mirror, and emits the light beam L corresponding to one of the toners to the photoconductor 62. The photoconductor 62 is provided at a lower side (at the −Y side) of the exposure unit 66.

Figure 2:
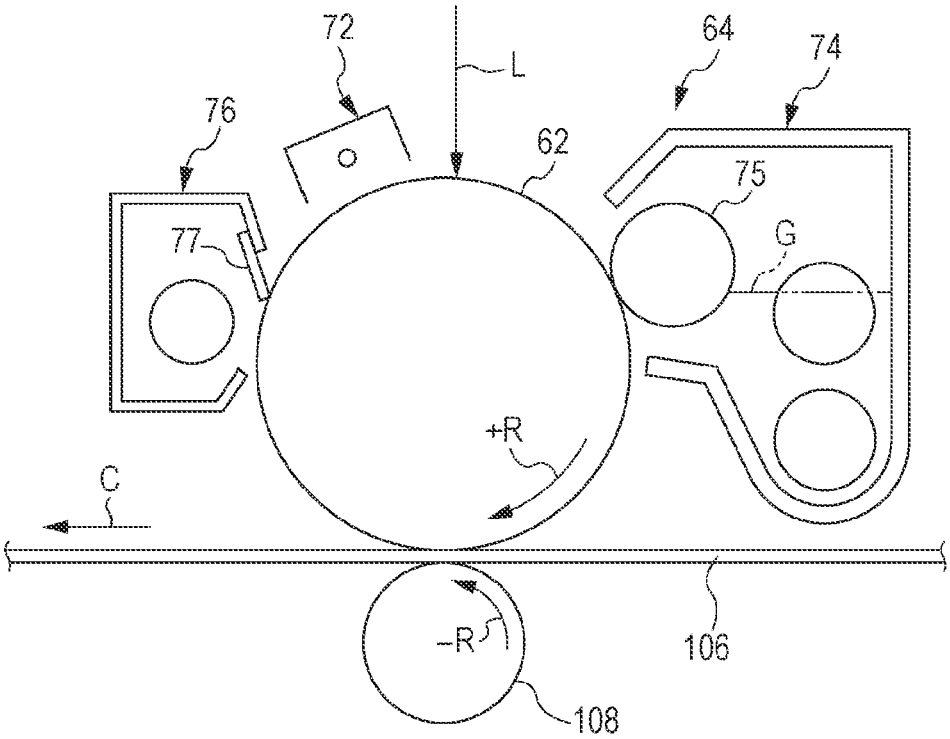
FIG. 2 is a configuration diagram of an image forming unit according to the first exemplary embodiment.

As shown in FIG. 2, the image forming unit 64 includes the photoconductor 62 provided rotatably around the arrow +R direction (clockwise in the drawing), and also a charging device 72, a developing device 74, and a cleaning unit 76, which face the outer peripheral surface of the photoconductor 62 and which are arranged from an upstream side to a downstream side in a rotation direction. The charging device 72 and the developing device 74 are arranged so that the light beam L is emitted on the outer peripheral surface of the photoconductor 62, at a position between the charging device 72 and the developing device 74. Also, an intermediate transfer belt 106 contacts the outer peripheral surface of the photoconductor 62, at a position between the developing device 74 and the cleaning unit 76.

The photoconductor 62 is formed of a cylindrical base member (not shown) that is made of, for example, aluminum, has conductivity, and is grounded; and a surface layer (not shown) including an electric-charge generation layer, an electric-charge carry layer, and a protection layer, which are successively laminated on an outer peripheral surface of the base member in the radial direction. The photoconductor 62 is rotatable in the arrow +R direction by driving of a motor (not shown). Also, for example, the charging device 72 is formed of a corotron charge unit that charges the outer peripheral surface of the photoconductor 62 with electricity having the same polarity as that of the toner through a corona discharge by applying a voltage to a wire. The outer peripheral surface of the photoconductor 62 charged with electricity is irradiated with the light beam L in accordance with image data. Hence, a latent image (an electrostatic latent image) is formed.

The developing device 74 houses, for example, the developer G in which a carrier particle made of a magnetic substance and a toner are mixed. The developing device 74 includes a cylindrical developing sleeve 75 having therein a magnet roller (not shown) with plural magnetic poles arranged in the circumferential direction. The developing sleeve 75 rotates and hence the developing device 74 forms a magnetic brush at a portion facing the photoconductor 62. Also, a voltage apply unit (not shown) applies a development bias to the developing sleeve 75. Hence, the latent image on the outer peripheral surface of the photoconductor 62 is developed with the toner, and a toner image (a developer image) is formed. The developing device 74 is supplied with a toner from a corresponding toner cartridge 79 (see FIG. 1) provided above the image forming device 60.

The cleaning unit 76 includes a cleaning blade 77, which is arranged such that a distal end of the cleaning blade 77 is directed along the rotation direction of the photoconductor 62 and which contacts the outer peripheral surface of the photoconductor 62. The cleaning blade 77 scrapes the toner remaining on the outer peripheral surface of the photoconductor 62 after the transfer and recovers the toner. Also, the intermediate transfer belt 106 is provided downstream of the developing device 74 in the rotation direction of the photoconductor 62. The toner image developed by the developing device 74 is first-transferred on the intermediate transfer belt 106.

As shown in FIG. 1, a transport belt 96 is provided downstream of a second transfer roller 118 as an example of a transfer member (described later) in a moving direction of the recording paper P. The transport belt 96 transports the recording paper P after the second transfer of the toner image to the fixing device 90 (described later). The transport belt 96 may be circulated by a support roller 97, a driving roller 98, and a driving unit having a motor and a gear (not shown) to transport the recording paper P to the fixing device 90.

The fixing device 90 includes a heat roller 92 and a pressure roller 94. The heat roller 92 applies heat by using a halogen lamp (not shown) which is a heat source. The pressure roller 94 is urged to the heat roller 92, pinches the recording paper P together with the heat roller 92, and applies pressure to the recording paper P. When the recording paper P after the second transfer enters an area between the heat roller 92 and the pressure roller 94, the fixing device 90 fixes the toner image to the recording paper P by action of heat and pressure.

A cleaning blade 95 is provided near a driving roller 112, at a position at which the cleaning blade 95 faces the outer peripheral surface of the intermediate transfer belt 106. The cleaning blade 95 removes the remaining toner and paper dust on the intermediate transfer belt 106 after the second transfer. Also, for example, a seal member (not shown) that reflects light is fixed to the outer peripheral surface of the intermediate transfer belt 106, at a reference position in a non-transfer region where the toner image is not transferred. A position sensor (not shown) is provided at a position at which the position sensor is able to face the seal member. The position sensor irradiates the non-transfer region of the intermediate transfer belt 106 with light, receives light reflected by the seal member, and hence detects the reference position of the intermediate transfer belt 106. Accordingly, the image forming device 60 performs image formation operations of the respective units in accordance with the signal of the reference position obtained by the position sensor.

In the image forming apparatus 10, the apparatus body 13 is formed of plural frame members and plate members. The X, −X, Z, and −Z sides are covered with covering members 15 (see FIG. 5). Also, the drawer unit 80 is provided in a lower portion of the apparatus body 13 (a portion below the intermediate transfer belt 106).

Figure 5:
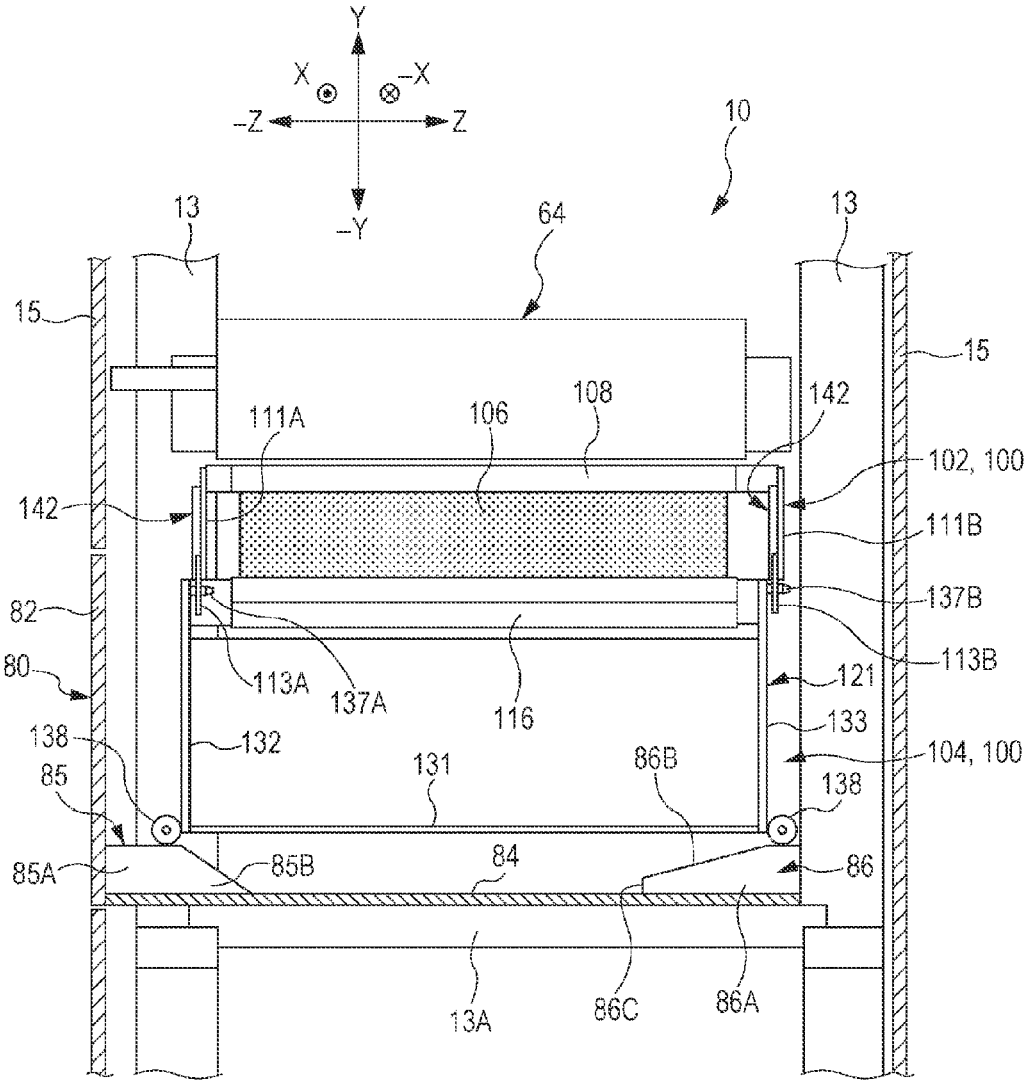
FIG. 5 is an explanatory view showing a state when the image forming apparatus is viewed in the −X direction according to the first exemplary embodiment.

As shown in FIG. 5, the drawer unit 80 includes a covering member 82 that covers the −Z side, and a rail member 84 that extends from an end (a lower end) at the −Y side of the covering member 82 toward the Z direction when the image forming apparatus 10 is viewed in the Z direction. A plate-shaped bottom portion 13A is provided in the apparatus body 13 and extends along the X-Z plane (a substantially horizontal plane). The rail member 84 is guided by a guide member (not shown) the is provided on the bottom portion 13A and has a C-shaped X-Y cross section. Accordingly, the drawer unit 80 is pulled out toward the −Z side with respect to the apparatus body 13, or pushed in toward the Z side and mounted in the apparatus body 13. The drawer unit 80 has a coupling portion 85 provided at the Z side of the covering member 82 and being adjacent to a surface of the −Y-side end portion (a lower end portion) of the covering member 82.

The coupling portion 85 includes a base 85A having a trapezoidal cross section when viewed in the −X direction. Two pairs of brackets (not shown) are provided on the base 85A at an interval in the X direction. Casters 138 provided at the −Z side of a housing 121 (described later) are rotatably coupled to the brackets.

Further, an inclined portion 85B that is lowered in the −Y direction toward the Z direction is formed at the base 85A. Since the housing 121 is provided with the inclined portion 85B, the height of an end portion at the Z side may be the same as the height of an end portion at the −Z side (horizontal arrangement), or the height of the end portion at the Z side may be lower than the height of the end portion at the −Z side (inclined arrangement).

Also, a ride portion 86 is provided at an end portion at the Z side of the apparatus body 13, at a portion on the bottom portion 13A. The ride portion 86 forms part of the apparatus body 13. The casters 138 at the Z side of the housing 121 are able to ride the ride portion 86.

The ride portion 86 includes a base 86A having a trapezoidal cross section when viewed in the −X direction. The base 86A has an upper surface that is a substantially horizontal plane. Also, the base 86A includes an inclined portion 86B that is lowered in the −Y direction toward the −Z direction, and a step portion 86C formed at an end portion at the −Z side of the inclined portion 86B and formed of a surface vertically arranged along the Y direction. Regarding the housing 121, if the casters 138 reach the upper surface of the base 86A through the inclined portion 86B, the height of the end portion at the −Z side becomes the same as the height of the end portion at the Z side (horizontal arrangement).

As shown in FIG. 1, the drawer unit 80 has mounted therein the positioning roller 38, a second unit 104 (described later), the transport belt 96 (including the support roller 97 and the driving roller 98), and the fixing device 90. The fixing device 90 is removably attached to the drawer unit 80. When the fixing device 90 is removed from the apparatus body 13, the drawer unit 80 is pulled out in the −Z direction, and then the fixing device 90 is moved in the Y direction.

Image Forming Process

Next, image formation steps by the image forming apparatus 10 are described.

As shown in FIG. 1, in the image forming apparatus 10, the outer peripheral surfaces of the photoconductors 62 are charged with electricity by the charging devices 72 (see FIG. 2), and the outer peripheral surfaces of the photoconductors are exposed to the light beams L emitted from the exposure units 66 in accordance with the image data. Hence, electrostatic latent images are formed on the outer peripheral surfaces of the photoconductors 62.

Then, the electrostatic latent images formed on the outer peripheral surfaces of the photoconductors 62 are developed by the developing devices 74 (see FIG. 2), as toner images of the respective colors including yellow (Y), magenta (M), cyan (C), and black (K).

Then, the toner images formed on the surfaces of the photoconductors 62 are successively transferred in an overlap manner on the intermediate transfer belt 106 by first transfer rollers 108 (described later). The toner image transferred in an overlap manner on the intermediate transfer belt 106 is second-transferred by a counter roller 116 and the second transfer roller 118 onto the recording paper P transported through the transport path 30.

Then, the recording paper P with the toner image transferred is transported by the transport belt 96 toward the fixing device 90. The fixing device 90 fixes the toner image on the recording paper P to the recording paper P by applying heat and pressure. The recording paper P with the toner image fixed is output to, for example, the paper output portion 11. In this way, a series of image forming steps is performed. If a toner image is formed on a non-image surface with no image formed yet (in case of duplex image formation), after the image is fixed to the front surface by the fixing device 90, the recording paper P is sent to the duplex transport path 31, and an image is formed on and fixed to the back surface.

Feature Part Configuration

Next, an example of the transfer unit 100 is described.

As shown in FIG. 1, the transfer unit 100 includes a first unit 102 and the second unit 104. The first unit 102 has the first transfer roller 108 that causes a toner image on the photoconductors 62 to be first-transferred onto the intermediate transfer belt 106. The second unit 104 has the second transfer roller 118 that causes the toner image on the intermediate transfer belt 106 to be second-transferred onto the recording paper P. Further, the transfer unit 100 includes a retract mechanism 140 as an example of an urging portion that urges the second transfer roller 118 to the counter roller 116 as an example of a wound member (described later) or releases the urging.

The first unit 102 includes the intermediate transfer belt 106 as an example of an endless transferred body, first transfer rollers 108K, 108C, 108M, and 108Y, and the counter roller 116 that faces the second transfer roller 118 with the intermediate transfer belt 106 arranged therebetween. The first unit 102 is attached to the apparatus body 13.

For example, the intermediate transfer belt 106 is formed of a film-shaped endless belt formed by adding carbon black (an antistatic agent) to a resin made of polyimide or polyamide. Also, the driving roller 112 that is arranged near the image forming unit 64Y and the first transfer roller 108Y and is rotationally driven by the motor (not shown), and plural transport rollers 114 that are rotatable are arranged inside the intermediate transfer belt 106.

A pair of side walls 111A and 111B (see FIG. 4) are provided at the −Z side and the Z side of the intermediate transfer belt 106 to be vertically arranged along the X-Y plane. The side walls 111A and 111B support the first transfer rollers 108K, 108C, 108M, and 108Y, the driving roller 112, the plural transport rollers 114, and the counter roller 116, rotatably around the Z direction as the axial direction.

Figure 3:
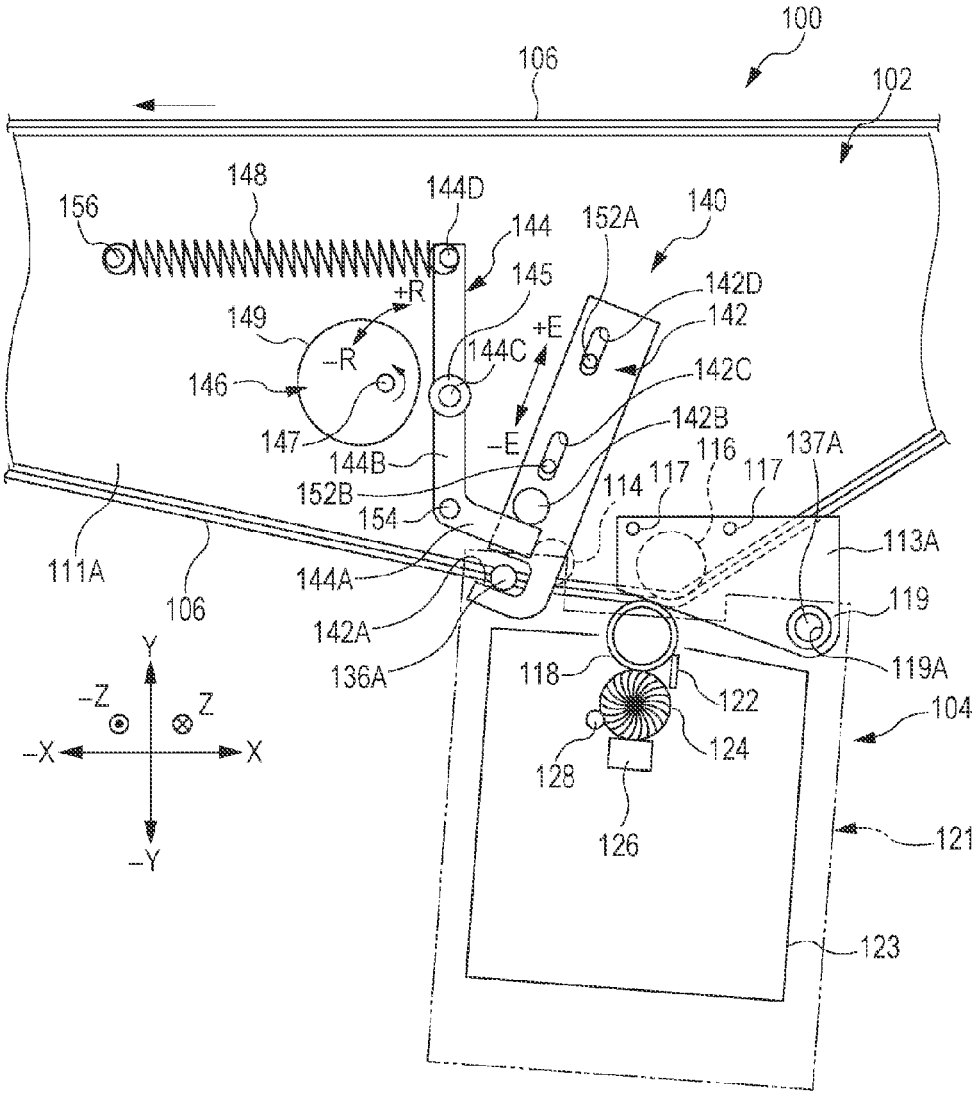
FIG. 3 is a configuration diagram of a transfer device according to the first exemplary embodiment.
Figure 4:
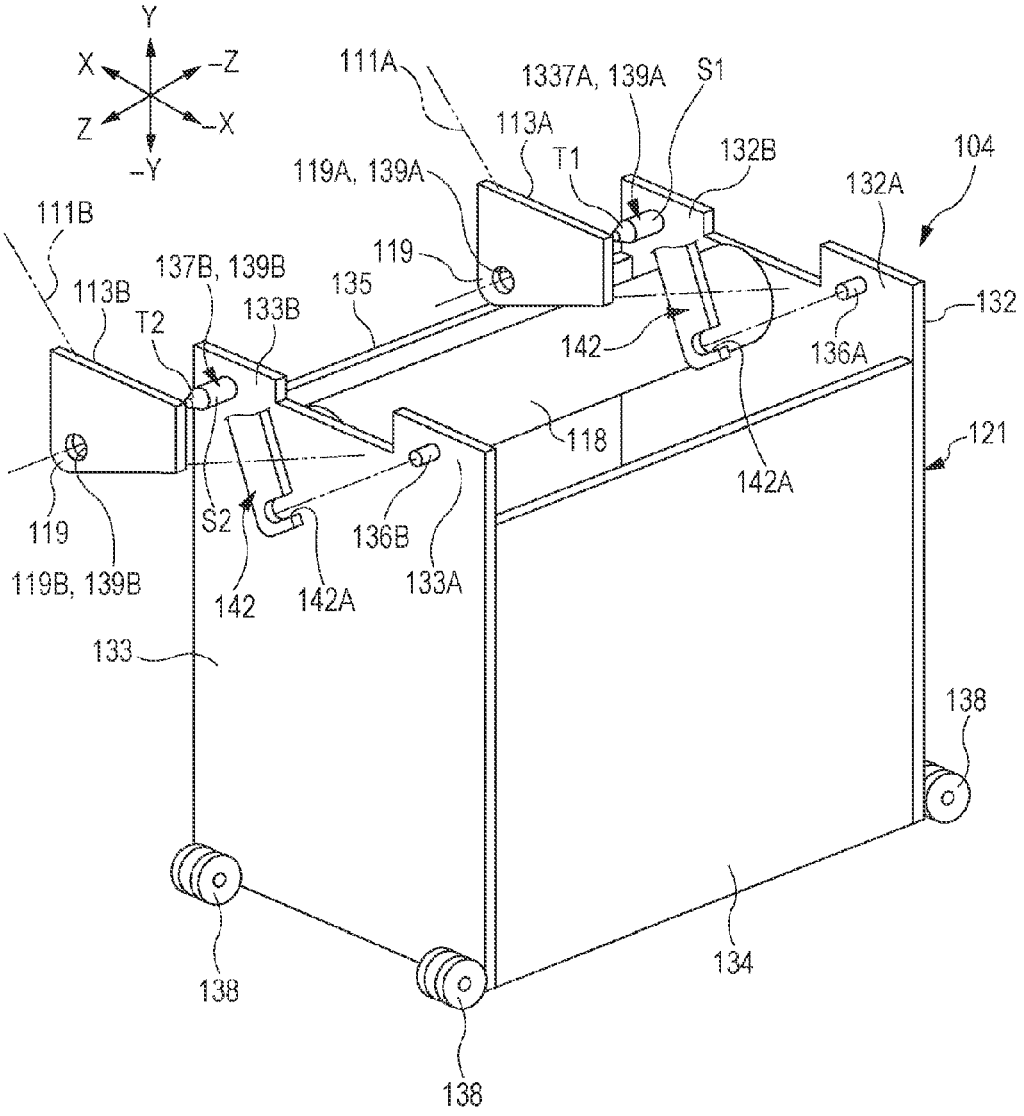
FIG. 4 is a perspective view of a state immediately before a stud of a housing is fitted to a through hole of a bracket according to the first exemplary embodiment.

As shown in FIGS. 3 and 4, brackets 113A and 113B are fastened by plural screws 117 at positions of the side walls 111A and 111B facing both ends of the counter roller 116. The side walls 111A and 111B and the brackets 113A and 113B are an example of a first support member that supports the counter roller 116.

The brackets 113A and 113B are plate-shaped members extending along the side walls 111A and 111B. For example, lower ends at the X side extend toward the −Y side as compared with lower ends at the −X side, and hence attached portions 119 are formed. The attached portion 119 of the bracket 113A has a through hole 119A with a size that allows a first stud 137A (described later) to be detachably fitted. The attached portion 119 of the bracket 113B has a through hole 119B with a size that allows a second stud 137B (described later) to be detachably fitted. The through holes 119A and 119B are coaxially arranged.

As shown in FIG. 1, the intermediate transfer belt 106 is wound around the driving roller 112, the plural transport rollers 114, and the counter roller 116. Accordingly, when the driving roller 112 is rotated counterclockwise in the drawing, the intermediate transfer belt 106 is circulated in the arrow C direction (counterclockwise in the drawing). The first transfer rollers 108K, 108C, 108M, and 108Y contact an inner peripheral surface of the intermediate transfer belt 106.

The first transfer roller 108 has, for example, a columnar shaft (not shown) formed of metal such as stainless steel. Also, the first transfer roller 108 is rotatable in the arrow −R direction (see FIG. 2) because both ends of the shaft are supported by bearings provided at the side walls 111A and 111B (see FIG. 4). Further, a voltage with a polarity opposite to the polarity of the toner is applied to the shaft of the first transfer roller 108 from a power source (not shown).

The counter roller 116 forms a counter electrode of the second transfer roller 118. A second transfer voltage is applied to the counter roller 116 through a power feed roller (not shown) made of metal and being in contact with the outer peripheral surface of the counter roller 116. When the second transfer voltage is applied to the counter roller 116 and a potential difference is generated between the counter roller 116 and the second transfer roller 118, the toner image on the intermediate transfer belt 106 is second-transferred on the recording paper P that is transported to the contact portion between the second transfer roller 118 and the intermediate transfer belt 106.

As shown in FIG. 3, the second unit 104 includes the housing 121 as an example of a second support member that forms a unit body, the second transfer roller 118 provided in the housing 121 rotatably around the Z direction as the axial direction, and a recovery container 123 that is provided below the second transfer roller 118 in the housing 121 and recovers a waste toner (a toner removed from the second transfer roller 118).

Further, the second unit 104 includes a cleaning blade 122, a brush roller 124, and a columnar scrape member 128. The cleaning blade 122 cleans the outer peripheral surface of the second transfer roller 118. The brush roller 124 cleans dust and other substance remaining on the outer peripheral surface of the second transfer roller 118 after the cleaning by the cleaning blade 122, and applies a lubricant 126 made of, for example, zinc stearate to the outer peripheral surface of the second transfer roller 118. The scrape member 128 is provided at a position at which the scrape member 128 contacts the brush roller 124, and scrapes dust and other substance remaining at the brush roller 124. In FIG. 3, the arrangement order is determined such that the cleaning blade 122 cleans the outer peripheral surface of the second transfer roller 118, and then the brush roller 124 applies the lubricant 126 to the second transfer roller 118. However, the arrangement order may be reversed. The brush roller 124 may apply the lubricant 126 to the second transfer roller 118, and then the second cleaning blade 122 may clean the second transfer roller 118.

For example, the second transfer roller 118 has a similar configuration to the first transfer roller 108 (see FIG. 1). The second transfer roller 118 is arranged downstream of the positioning roller 38 (see FIG. 1) in the transport direction of the recording paper P in the transport path 30 (see FIG. 1) and is rotatable. Also, the second transfer roller 118 contacts the outer peripheral surface of the intermediate transfer belt 106 so that the second transfer roller 118 and the counter roller 116 pinch the intermediate transfer belt 106 (and the recording paper P, not shown). The second transfer roller 118 is electrically grounded.

As shown in FIG. 5, the housing 121 has a rectangular bottom plate 131 arranged along the X-Z plane and has the longitudinal direction along the Z direction. Also, as shown in FIG. 4, the housing 121 has side walls 132, 133, 134, and 135 that are vertically arranged on the periphery of the bottom plate 131 (see FIG. 5).

The side wall 132 is vertically arranged on a −Z-side end of the bottom plate 131 (see FIG. 5) and extends along the X-Y plane. The side wall 133 is vertically arranged on a Z-side end of the bottom plate 131 and extends along the X-Y plane. The side walls 132 and 133 have, for example, the same size and shape.

For example, regarding the side wall 132, at a Y-side end (an upper end) of a rectangular plate member, an end portion at the X side and an end portion at the −X side protrude in the Y direction with respect to a center portion in the X direction. That is, the side wall 132 has a first protrusion 132A that protrudes in the Y direction at the −X side, and a second protrusion 132B that protrudes in the Y direction at the X side.

The first protrusion 132A is provided with a columnar first pin 136A that protrudes in the Z direction from a Z-side surface while the Z direction serves as the axial direction. The second protrusion 132B is provided with the first stud 137A that protrudes in the Z direction from the Z-side surface while the Z direction serves as the axial direction. The first stud 137A has a columnar shaft portion S1 and a tapered portion T1 having a truncated cone shape protruding from a Z-side end of the shaft portion. The outer diameter of the tapered portion T1 is smaller than the hole diameter of the through hole 119A, and the outer diameter of the shaft portion S1 has a size that allows the shaft portion S1 to be fitted to a hole wall of the through hole 119A.

For example, regarding the side wall 133, at a Y-side end (an upper end) of a rectangular plate member, an end portion at the X side and an end portion at the −X side protrude in the Y direction with respect to a center portion in the X direction. That is, the side wall 133 has a first protrusion 133A that protrudes in the Y direction at the −X side, and a second protrusion 133B that protrudes in the Y direction at the X side.

The first protrusion 133A is provided with a columnar second pin 136B that protrudes in the Z direction from a Z-side surface while the Z direction serves as the axial direction. The second protrusion 133B is provided with the second stud 137B that protrudes in the Z direction from the Z-side surface while the Z direction serves as the axial direction. The second stud 137B has a columnar shaft portion S2 and a tapered portion T2 having a truncated cone shape protruding in the Z direction from a Z-side end of the shaft portion. The outer diameter of the tapered portion T2 is smaller than the hole diameter of the through hole 119B, and the outer diameter of the shaft portion S2 has a size that allows the shaft portion S2 to be fitted to a hole wall of the through hole 119B.

The shaft center position of the first stud 137A and the shaft center position of the second stud 137B are the same position in the X-Y plane. That is, the first stud 137A and the second stud 137B are coaxially arranged along the axial direction (the Z direction) of the second transfer roller 118. Also, the first stud 137A, the through hole 119A (the bracket 113A), the second stud 137B, and the through hole 119B (the bracket 113B) are arranged in that order in the Z direction in the state shown in FIG. 4. Further, the first stud 137A and the second stud 137B have the same size, and the first pin 136A and the second pin 136B have the same size.

The first stud 137A and the hole wall of the through hole 119A form a fitting structure 139A. The second stud 137B and the hole wall of the through hole 119B form a fitting structure 139B. That is, in the fitting structures 139A and 139B, the first stud 137A and the hole wall of the through hole 119A are detachably fitted to each other, and the second stud 137B and the hole wall of the through hole 119B are detachably fitted to each other, along the Z direction, at the deep side (the Z side) and the near side (the −Z side) of the apparatus body 13 (see FIG. 5).

Also, the fitting structures 139A and 139B are an example of a coupling portion that couples the housing 121 to the side walls 111A and 111B, and to the bracket 113A and 113B in a manner that the relative angle of the housing 121 may be changed in the X-Y plane. That is, in a state in which the fitting structures 139A and 139B provides fitting, the angle of the housing 121 relative to the side walls 111A and 111B, and the bracket 113A and 113B may be changed around the coaxially arranged first stud 137A and second stud 137B as the rotation center (pivot).

The side wall 134 is vertically arranged on a −X-side end of the bottom plate 131 (see FIG. 5) and extends along the Y-Z plane. The side wall 135 is vertically arranged on an X-side end of the bottom plate 131 and extends along the Y-Z plane. The side walls 134 and 135 have, for example, rectangular shapes having the same size and shape, and having a lower height in the Y direction than the side walls 132 and 133. As described above, the housing 121 has a box shape being open to the Y side.

As shown in FIG. 4, the two casters 138 (one of them being not shown) are provided at an interval in the X direction, at a −Y-side end on a surface at the −Z side of the side wall 132. Similarly, the two casters 138 are provided at an interval in the X direction, at a −Y-side end of the side wall 133 on a surface at the Z side. In this exemplary embodiment, since the two casters 138 at the side wall 132 are coupled to the coupling portion 85 as an example, only the two casters 138 at the side wall 133 are rotated.

Next, the retract mechanism 140 is described.

The retract mechanism 140 has similar configurations at the Z side (the side-wall-111A side) and the −Z side (the side-wall-111B side) of the transfer unit 100. Hence, only the configuration at the −Z side (the near side) is described, and description for the configuration at the Z side (the deep side) is omitted.

As shown in FIG. 3, the retract mechanism 140 includes the first pin 136A, a bracket 142 that moves the first pin 136A in a predetermined direction (the arrow +E direction and the arrow −E direction in the drawing), a lever member 144 that moves the bracket 142 in the +E direction and the −E direction, an eccentric cam 146 that displaces the lever member 144, and an extension coil spring 148 that pulls one end of the lever member 144. The +E direction is substantially parallel to a direction in which the second transfer roller 118 moves toward the counter roller 116. The −E direction is substantially parallel to a direction in which the second transfer roller 118 moves away from the counter roller 116.

The bracket 142 has a hook portion 142A formed by cutting one end portion (at the −E side) in the longitudinal direction of the rectangular plate member arranged along the X-Y plane, from one side in the short-side direction. Also, a columnar urged portion 142B is provided at the +E side with respect to the hook portion 142A of the bracket 142. The urged portion 142B protrudes in the −Z direction. Further, two long holes 142C and 142D are formed at the +E side with respect to the urged portion 142B of the bracket 142. The long holes 142C and 142D are arranged at an interval in the +E direction and has the longitudinal direction along the +E direction.

The side wall 111A has columnar guide pins 152A and 152B that are arranged at an interval along the +E direction and protrude in the −Z direction. The diameters of the guide pins 152A and 152B are slightly smaller than a smaller one of lengths in the width direction of the long holes 142C and 142D. Also, the side wall 111A has a columnar support shaft 154 at a position at the −X side with respect to the lower guide pin 152B, at a position separated to the −Y side. The support shaft 154 protrudes in the −Z direction. Further, the side wall 111A has a columnar hook pin 156 at a position at the −X side with respect to the support shaft 154, at a position separated toward the Y side. The hook pin 156 protrudes in the −Z direction.

The lever member 144 formed into a plate shape by integrating a short-side portion 144A and a long-side portion 144B. The short side portion 144A extends from the support shaft 154 toward the-bracket-142 side. The long side portion 144B extends from the support shaft 154 so as to be away from the bracket 142. The lever member 144 is rotatably coupled to the support shaft 154 by using a bearing (not shown).

An upper surface at the Y side of the short-side portion 144A contacts the urged portion 142B of the bracket 142. Also, a ring-shaped cam follower 145 is provided at a center portion of the long-side portion 144B. The cam follower 145 is rotatable around a columnar shaft portion 144C protruding in the −Z direction. Further, a columnar hook pin 144D is provided at a distal end side (a side opposite to the support-shaft-154 side) of the long-side portion 144B. The hook pin 144D protrudes in the −Z direction.

In a state in which the urged portion 142B of the bracket 142 contacts the short-side portion 144A of the lever member 144, one end of the extension coil spring 148 is hooked to the hook pin 144D. Further, the other end of the extension coil spring 148 is hooked to the hook pin 156. Accordingly, the extension coil spring 148 extends from a natural length, and a tensile force for rotation in the −R direction (counterclockwise in the drawing) acts on the distal end of the long-side portion 144B of the lever member 144. With this tensile force, an urging force that causes the short-side portion 144A to lift the urged portion 142B in the +E direction acts. Hence, the bracket 142 is lifted in the +E direction. In this lifted state, the hook portion 142A of the bracket 142 lifts the first pin 136A in the +E direction. Hence, the counter roller 116 contacts the second transfer roller 118.

Also, the side wall 111A has a columnar support shaft 147 at a portion at the −X side with respect to the cam follower 145. The support shaft 147 protrudes in the −Z direction. An eccentric cam 149 is provided rotatably with the support shaft 147 along the X-Y plane.

A peripheral surface portion of the eccentric cam 149 being the farthest from the center by the rotation of the motor (not shown) contacts the cam follower 145, the lever member 144 is rotated in the +R direction, and hence the second transfer roller 118 is separated from the counter roller 116. In this exemplary embodiment, in a state in which the counter roller 116 contacts the second transfer roller 118, for example, the peripheral surface of the eccentric cam 149 does not contact the cam follower 145.

Comparative Example

Next, a transfer device 200 according to a comparative example is described.

Figure 10:
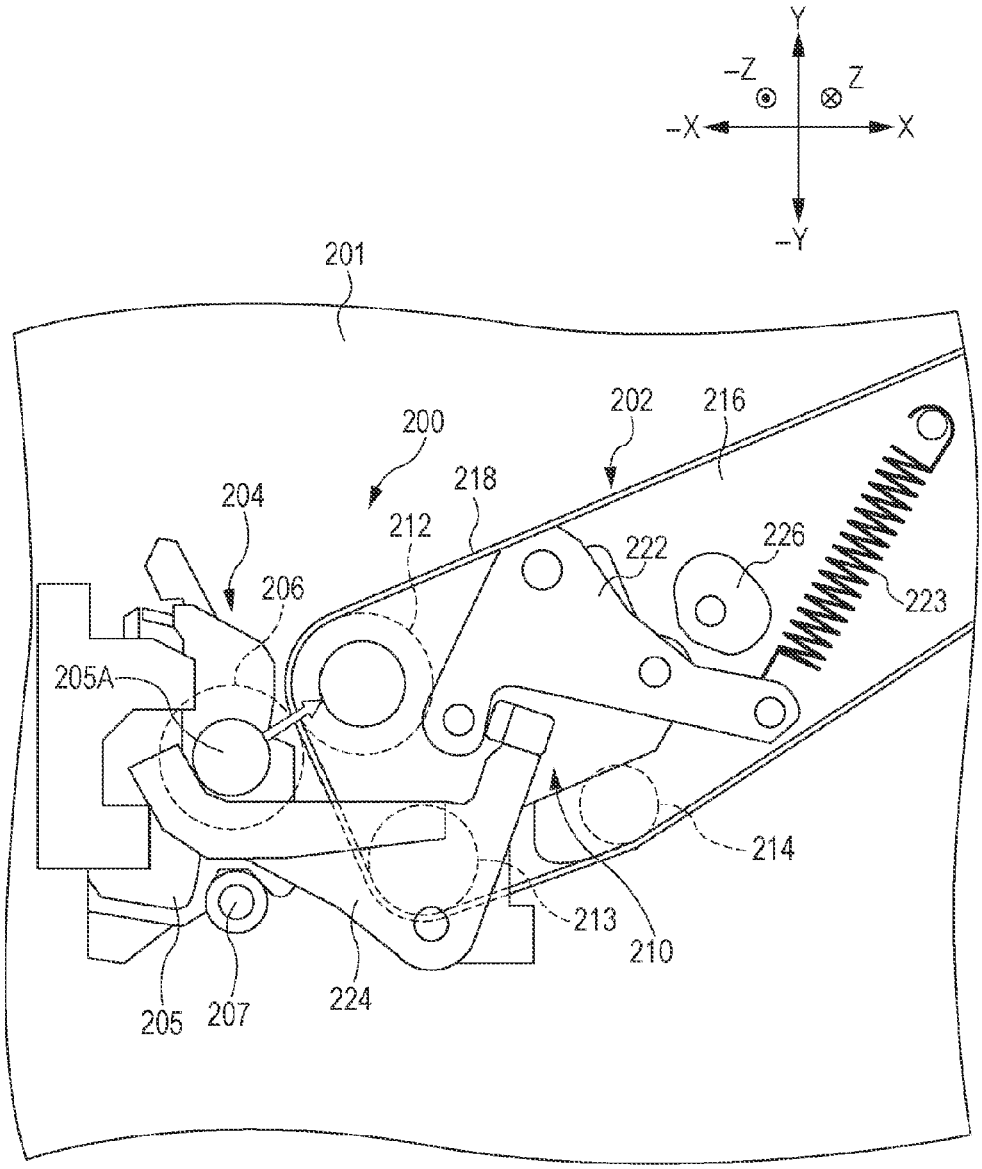
FIG. 10 is an explanatory view showing a state when a transfer device is viewed in the Z direction according to a comparative example.

FIG. 10 shows a peripheral portion of a second transfer position in the transfer device 200 according to the comparative example. The transfer device 200 of the comparative example includes an intermediate transfer unit 202 on which a toner image is first-transferred from an image forming unit (not shown), a second unit 204 that second-transfers the toner image on the intermediate transfer unit 202 onto recording paper P (not shown), and a retract mechanism 210 that urges a second transfer roller 206 (described later) to a counter roller 212. Also, the intermediate transfer unit 202 and the second unit 204 are individually attached to a device body 201.

The intermediate transfer unit 202 includes support rollers 213 and 214 having the axial direction along the Z direction, a pair of side plates 216 that rotatably support the counter roller 212 and the support rollers 213 and 214, and an intermediate transfer belt 218 that is wound around the counter roller 212, and the support rollers 213 and 214.

The second unit 204 includes a housing 205 and the second transfer roller 206 that is rotatably supported by the housing 205 and has the axial direction along the Z direction. Also, regarding the second unit 204, the housing 205 is engaged with a pivot member 207 provided at the device body 201 and having the axial direction along the Z direction. Hence, the second unit 204 is swingable in a direction toward or away from the intermediate transfer unit 202 around the pivot member 207. The housing 205 has a columnar protrusion 205A protruding in the −Z direction.

The retract mechanism 210 includes a first link member 222, a second link member 224, an extension coil spring 223, and an eccentric cam 226 swingably supported by the side plate 216. One end of the first link member 222 is pulled by the extension coil spring 223. The other end of the first link member 222 contacts one end of the second link member 224. The other end of the second link member 224 contacts the protrusion 205A of the housing 205.

With the transfer device 200 according to the comparative example, the other end of the first link member 222 presses the one end of the second link member 224 by a tensile force of the extension coil spring 223. Accordingly, the second link member 224 is rotated clockwise in the drawing. Also, since the other end of the second link member 224 urges the protrusion 205A toward the intermediate transfer unit 202, the second transfer roller 206 is urged toward the counter roller 212. The eccentric cam 226 is rotatably provided at the side plate 216 at a position next to the first link member 222. When the eccentric cam 226 contacts the first link member 222 and the first link member 222 is rotated clockwise in the drawing, the second link member 224 is rotated, and hence the urged state of the second transfer roller 206 is released.

With the transfer device 200 of the comparative example, since the pivot member 207 that is the rotation center of the second unit 204 is provided at the device body 201, a cumulative tolerance between the counter roller 212 and the second transfer roller 206 contains an assembly tolerance of the retract mechanism 210, an assembly tolerance of the intermediate transfer unit 202 with respect to the device body 201, and an assembly tolerance of the second unit 204 with respect to the device body 201, and hence the cumulative tolerance increases.

If the cumulative tolerance between the counter roller 212 and the second transfer roller 206 increases, a variation in load that acts on the recording paper P in the axial direction (the Z direction) (a difference between a load at the −Z side and a load at the Z side) of these rollers increases, and force transmission efficiency decreases. A variation in load in the Z direction and in the −Z direction at the second transfer position result in that a displacement amount in the Z direction of the transferred toner image from a set position is different from a displacement amount in the −Z direction thereof. A distortion of the toner image increases.

Further, since the load that acts on recording paper P at the second transfer position varies, an excessive load that acts on the recording paper P when the second transfer roller 206 is urged to the counter roller 212 has to be largely estimated, and hence a large urging force is required. An excessive load is caused to previously act on the second transfer roller 206 to prevent the second transfer roller 206 from being pushed back because of the thickness of recording paper P when the recording paper P enters the second transfer position (the area between the counter roller 212 and the second transfer roller 206).

Operation

Next, operation of the first exemplary embodiment is described.

Figure 6A:
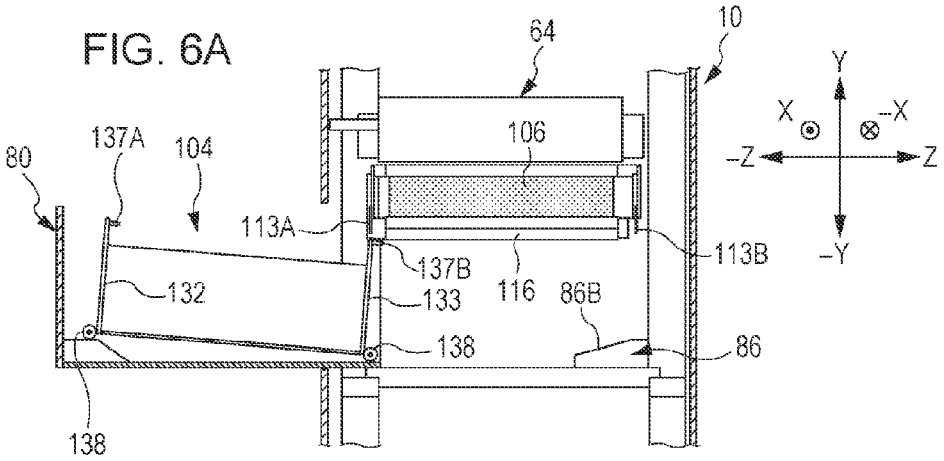
FIGS. 6A to 6C are explanatory views showing steps of mounting a drawer to an apparatus body and attaching a housing according to the first exemplary embodiment.

In the image forming apparatus 10, for example, as shown in FIG. 6A, if recording paper P is clogged at the second transfer position, a user (not shown) pulls out the drawer unit 80 toward the −Z side, and hence the user is able to remove the recording paper P. When the drawer unit 80 is pulled out in the −Z direction, after the first stud 137A and the second stud 137B are removed from the through holes 119A and 119B (see FIG. 4), the casters 138 at the Z side move down from the ride portion 86, and the second unit 104 is inclined such that the Z side descends toward the −Y direction. Accordingly, the Y-side end (the upper end) of the side wall 133 passes through a position below the −Y-side end (the lower end) of the bracket 113A, and the drawer unit 80 is pulled out in the −Z direction while the bracket 113A does not contact the side wall 133.

Figure 6B:
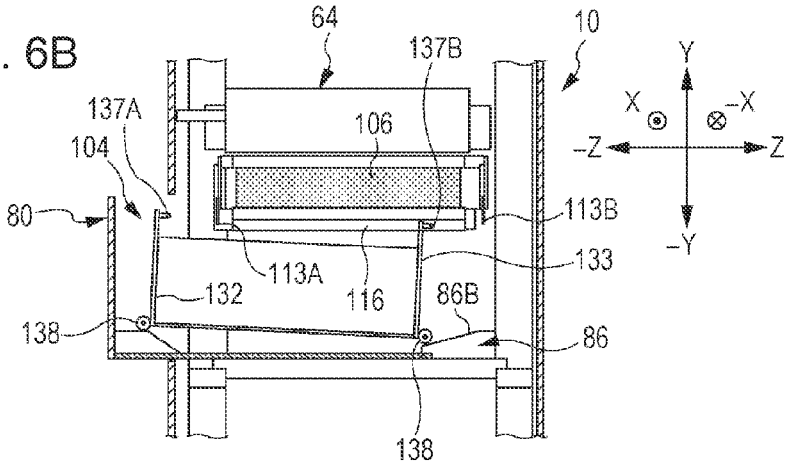

Then, as shown in FIG. 6B, when the user (not shown) pushes the drawer unit 80 in the Z direction, the Y-side end (the upper end) of the side wall 133 passes through the position below the −Y-side end (the lower end) of the bracket 113A, and the drawer unit 80 is pushed in the Z direction while the bracket 113A does not contact the side wall 133. Then, the casters 138 at the Z side ride the inclined portion 86B. The height position of the casters 138 at the Z side becomes higher in proportion to a pushing amount in the Z direction of the drawer unit 80.

Figure 6C:
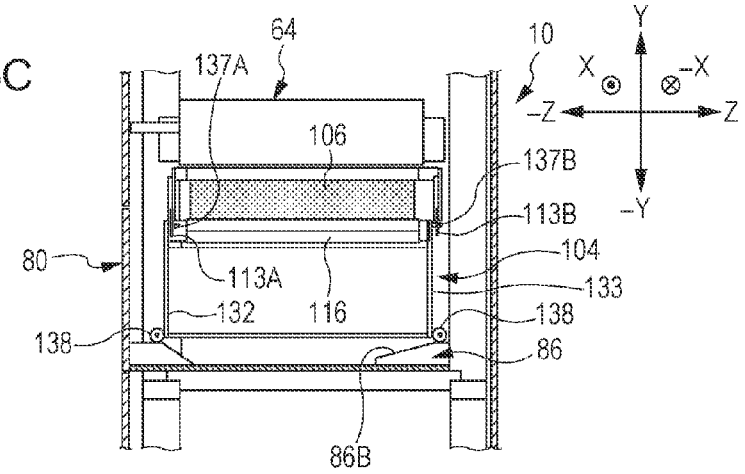

Then, as shown in FIG. 6C, when the drawer unit 80 is pushed in the Z direction, the height of the casters 138 at the −Z side becomes substantially the same as the height of the casters 138 at the Z side. When the drawer unit 80 is further pushed in the Z direction, as shown in FIG. 4, the stud 137A is fitted to the hole wall of the through hole 119A of the bracket 113A, and the stud 137B is fitted to the hole wall of the through hole 119B of the bracket 113B. Further, the first pin 136A and the second pin 136B are arranged in the hook portions 142A (the cut portions) of the pair of brackets 142.

Figure 7A:
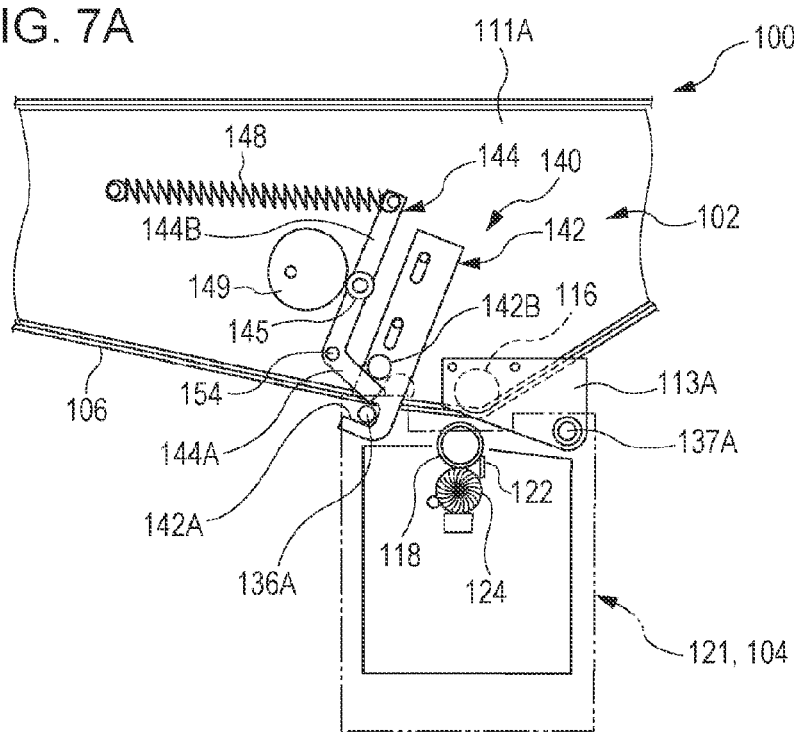
FIGS. 7A and 7B are explanatory views showing a state when a second transfer roller is urged toward a backup roller according to the first exemplary embodiment.

As shown in FIG. 7A, when the stud 137A is fitted to the bracket 113A, the peripheral surface portion far from the center of the eccentric cam 149 contacts the cam follower 145, the long-side portion 144B of the lever member 144 is displaced toward the bracket 142, the bracket 142 is lowered, and the second transfer roller 118 is arranged at a position separated from the counter roller 116. The bracket 113A and the bracket 113B (see FIG. 4) have similar configurations, and hence the description and illustration for the configuration of the bracket 113B are omitted.

Figure 7B:
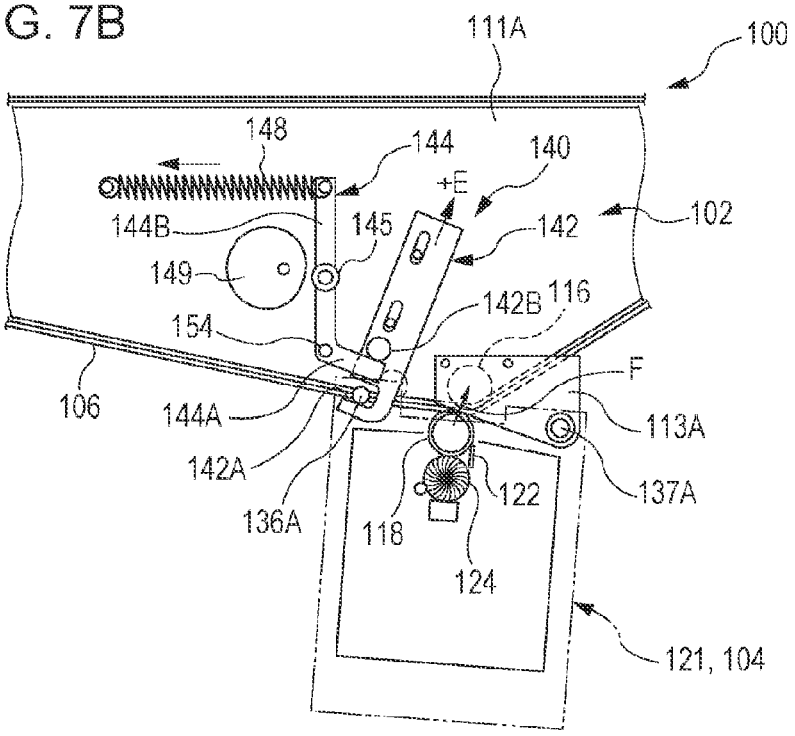

Then, as shown in FIG. 7B, when the eccentric cam 149 is rotated to a position at which the peripheral surface portion near the center faces the cam follower 145, the eccentric cam 149 and the cam follower 145 no longer contact each other. The lever member 144 is pulled by the tensile force of the extension coil spring 148, and is rotated counterclockwise in the drawing. The lever member 144 lifts the bracket 142 in the +E direction, and the first pin 136A in the +E direction.

Accordingly, the first-pin-136A side of the housing 121 is rotated counterclockwise in the drawing around the first stud 137A as the rotation center, and the second transfer roller 118 is pressed (urged) in the +E direction toward the counter roller 116. At the second transfer position, a pressing force F acts on the intermediate transfer belt 106 (and the recording paper P, not shown) pinched between the counter roller 116 and the second transfer roller 118.

In the transfer unit 100 according to the first exemplary embodiment, the first stud 137A that is the rotation center of the second unit 104 is not provided at the apparatus body 13 (see FIG. 5), but is provided at the first unit 102. Accordingly, the cumulative tolerance between the counter roller 116 and the second transfer roller 118 does not contain an assembly tolerance of the first unit 102 and an assembly tolerance of the second unit 104 with respect to the apparatus body 13. Accordingly, the transfer unit 100 involves the influence of only an assembly tolerance of the retract mechanism 140. The cumulative tolerance between the counter roller 116 and the second transfer roller 118 decreases as compared with the transfer device 200 of the comparative example. That is, relative positional accuracy between the second transfer roller 118 and the counter roller 116 increases.

Also, in the transfer unit 100, since the cumulative tolerance between the counter roller 116 and the second transfer roller 118 decreases, a variation in load that acts on the recording paper P in the axial direction (the Z direction) of these rollers (the difference between the load at the −Z side and the load at the Z side) decreases as compared with the transfer device 200 of the comparative example, and the force transmission efficiency increases as compared with the transfer device 200 of the comparative example. Accordingly, with the transfer unit 100, as compared with the transfer device 200 of the comparative example, the phenomenon in which the displacement amount of the toner image from the set position in the Z direction is different from the displacement amount in the −Z direction is restricted, and the distortion of the toner image is reduced. Hence, the excessive load that acts on the recording paper P when the second transfer roller 118 is urged to the counter roller 116 does not have to be largely estimated, and a required urging force decreases.

Second Exemplary Embodiment

Next, examples of a fixing device and an image forming apparatus according to a second exemplary embodiment of the invention are described.

The image forming apparatus according to the second exemplary embodiment differs from the image forming apparatus 10 according to the above-described first exemplary embodiment in that a transfer unit 160 as an example of a transfer device is provided instead of the transfer unit 100. Other configurations are similar to those of the image forming apparatus 10 and the transfer unit 100 according to the first exemplary embodiment. Hence, the image forming apparatus is described as the image forming apparatus 10 even in the second exemplary embodiment, the same reference signs of the first exemplary embodiment are applied to basically the same members and portions as those of the image forming apparatus 10 according to the first exemplary embodiment, and redundant description is omitted.

Figure 8:
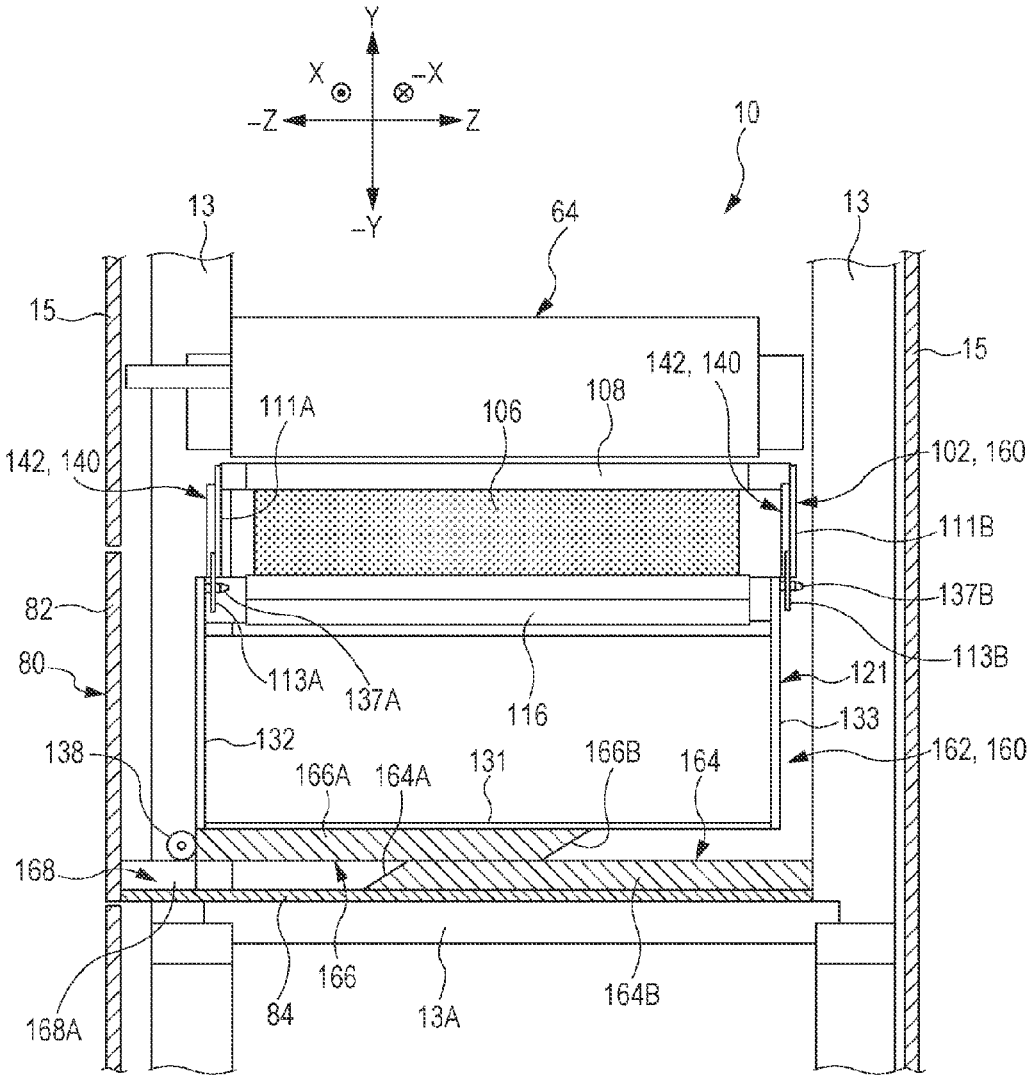
FIG. 8 is a configuration diagram of a transfer device according to a second exemplary embodiment.

As shown in FIG. 8, the transfer unit 160 according to the second exemplary embodiment includes the first unit 102, a second unit 162 that second-transfers a toner image on the intermediate transfer belt 106 onto recording paper P, and the retract mechanism 140.

The second unit 162 includes the second transfer roller 118 (see FIG. 4), and the housing 121 having the first pin 136A and the second pin 136B (see FIG. 4) and the first stud 137A and the second stud 137B. A lift portion 166 is provided on a lower surface of the bottom plate 131. The lift portion 166 contacts a ride portion 164 provided at the apparatus body 13 and lifts the housing 121 toward the side walls 111A and 111B and the brackets 113A and 113B. The ride portion 164 is included in the apparatus body 13.

The ride portion 164 is provided to extend from a center portion in the Z direction on the bottom portion 13A of the apparatus body 13 to a Z-side end. The ride portion 164 has a trapezoidal cross section when viewed in the −X direction. The ride portion 164 includes an inclined portion 164A that is lowered in the −Y direction toward the −Z direction, and a base portion 164B continued to the Z side of the inclined portion 164A and extends in the Z direction. An upper surface of the base portion 164B extends along a substantially horizontal plane.

The lift portion 166 is provided on the lower surface of the bottom plate 131 and extends from the center portion in the Z direction to a −Z-side end. Also, the lift portion 166 has a trapezoidal cross section when viewed in the −X direction. The lift portion 166 includes a base portion 166A having a rectangular cross section extending from the center portion in the Z direction toward the −Z side, and an inclined portion 166B continued to a Z-side end of the base portion 166A and ascending in the Y direction toward the Z direction. A lower surface of the base portion 166A extends along a substantially horizontal plane.

When the drawer unit 80 is mounted on the apparatus body 13, the base portion 166A rides the base portion 164B at the center portion in the Z direction, and the height of the Z-side end and the height of the −Z-side end of the housing 121 are substantially aligned with each other. The drawer unit 80 has a coupling portion 168 provided at the Z side of the covering member 82 and being adjacent to a surface of the −Y-side end portion (a lower end portion) of the covering member 82.

The coupling portion 168 includes a base 168A having a rectangular cross section when viewed in the −X direction. Two pairs of brackets (not shown) are provided on the base 168A at an interval in the X direction. The casters 138 provided at the −Z side of the housing 121 are rotatably coupled to the brackets.

With the housing 121, since the casters 138 are coupled to an upper end at the Z side of the coupling portion 168, the height of an end portion at the Z side may be the same as the height of an end portion at the −Z side (horizontal arrangement), or the height of the end portion at the Z side may be lower than the height of the end portion at the −Z side (inclined arrangement).

Operation

Next, operation of the second exemplary embodiment is described.

Figure 9A:
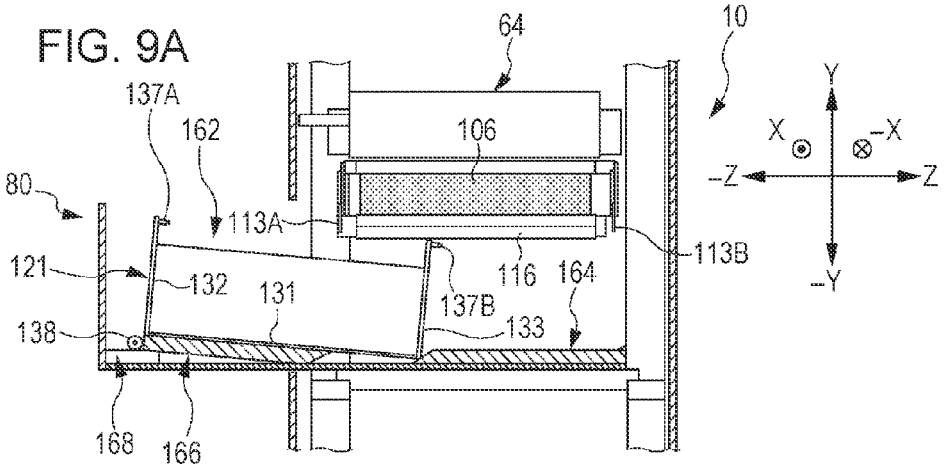
FIGS. 9A to 9C are explanatory views showing steps of mounting a drawer to an apparatus body and attaching a housing according to the second exemplary embodiment.

In the image forming apparatus 10 according to the second exemplary embodiment, for example, as shown in FIG. 9A, if recording paper P is clogged at the second transfer position, a user (not shown) pulls out the drawer unit 80 toward the −Z side, the user is able to remove the recording paper P. When the drawer unit 80 is pulled out in the −Z direction, the Z-side end of the bottom plate 131 moves down form the ride portion 164, and the second unit 162 is inclined such that the Z side descends toward the −Y direction. Accordingly, the Y-side end (the upper end) of the side wall 133 passes through a position below the −Y-side end (the lower end) of the bracket 113A, and the drawer unit 80 is pulled out in the −Z direction while the bracket 113A does not contact the side wall 133.

Figure 9B:
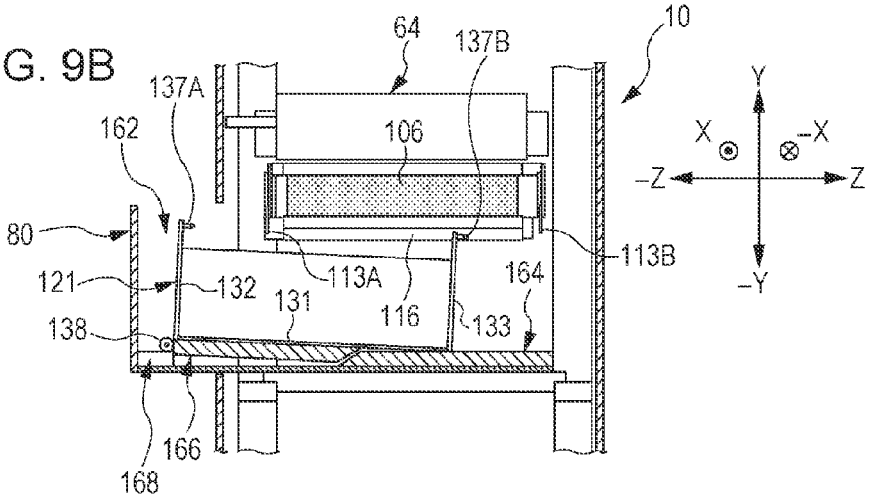

Then, as shown in FIG. 9B, when the user (not shown) pushes the drawer unit 80 in the Z direction, the Y-side end (the upper end) of the side wall 133 passes through the position below the −Y-side end (the lower end) of the bracket 113A, and the drawer unit 80 is pushed in the Z direction while the bracket 113A does not contact the side wall 133. Then, the Z-side end of the bottom plate 131 rides the ride portion 164.

Figure 9C:
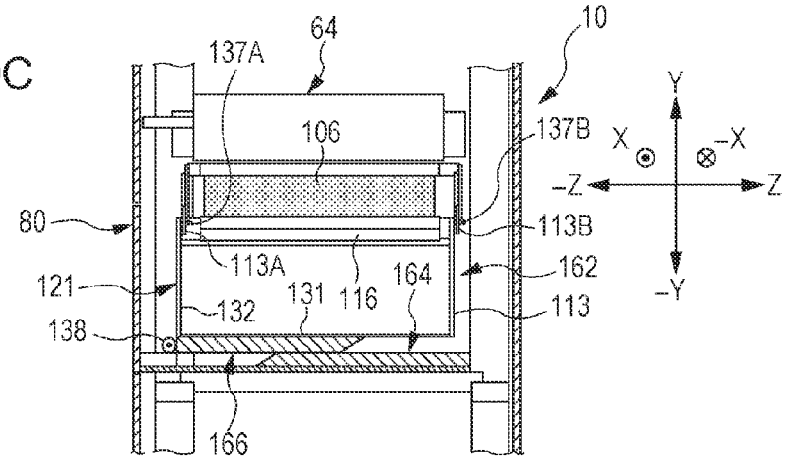

Then, as shown in FIG. 9C, when the drawer unit 80 is pushed in the Z direction, the lift portion 166 rides the ride portion 164, and the Z-side end of the housing 121 is lifted in the Y direction. Accordingly, the height at the −Z side and the height at the Z side of the upper end of the housing 121 become substantially the same. Then, when the drawer unit 80 is further pushed in the Z direction, as shown in FIG. 4, the stud 137A is fitted to the hole wall of the through hole 119A of the bracket 113A, and the stud 137B is fitted to the hole wall of the through hole 119B of the bracket 113B. Further, the first pin 136A and the second pin 136B are arranged in the hook portions 142A (the cut portions) of the pair of brackets 142.

Then, as shown in FIG. 7B, when the eccentric cam 149 is rotated to a position at which a portion with a small eccentricity faces the cam follower 145, the eccentric cam 149 and the cam follower 145 no longer contact each other. The lever member 144 is pulled by the tensile force of the extension coil spring 148, and is rotated counterclockwise in the drawing. The lever member 144 lifts the bracket 142 in the +E direction, and the first pin 136A in the +E direction.

Accordingly, the first-pin-136A side of the housing 121 is rotated counterclockwise in the drawing around the first stud 137A as the rotation center, and the second transfer roller 118 is pressed (urged) in the +E direction toward the counter roller 116. At the second transfer position, a pressing force F acts on the intermediate transfer belt 106 (and the recording paper P, not shown) pinched between the counter roller 116 and the second transfer roller 118.

With the transfer unit 160 of the second exemplary embodiment, the lift portion 166 rides the ride portion 164 of the apparatus body 13 by the mounting operation of pushing the drawer unit 80 in the Z direction to the apparatus body 13 (see FIG. 5) (the mounting operation of the housing 121 to the brackets 113A and 113B). Accordingly, the Z side of the housing 121 is lifted in the Y direction, and hence the height of the upper end of the housing 121 is equalized. As compared with a configuration in which a driving mechanism such as a motor is additionally provided to lift the Z side of the housing 121 in the Y direction, coupling between the brackets 113A, 113B (the side walls 111A, 111B) and the housing 121 is simple.

In the transfer unit 160, the first stud 137A that is the rotation center of the second unit 162 is not provided at the apparatus body 13 (see FIG. 5), but is provided at the first unit 102. Accordingly, the cumulative tolerance between the counter roller 116 and the second transfer roller 118 does not contain an assembly tolerance of the first unit 102 and an assembly tolerance of the second unit 162 with respect to the apparatus body 13. Accordingly, the transfer unit 160 involves the influence of only an assembly tolerance of the retract mechanism 140. The cumulative tolerance between the counter roller 116 and the second transfer roller 118 decreases as compared with the transfer device 200 of the comparative example. That is, the relative positional accuracy between the second transfer roller 118 and the counter roller 116 increases.

In the transfer unit 160, since the cumulative tolerance between the counter roller 116 and the second transfer roller 118 decreases, a variation in load that acts on the recording paper P in the axial direction (the Z direction) of these rollers (a difference between a load at the −Z side and a load at the Z side) decreases as compared with the transfer device 200 of the comparative example, and the force transmission efficiency increases as compared with the transfer device 200 of the comparative example. Accordingly, with the transfer unit 100, as compared with the transfer device 200 of the comparative example, the phenomenon in which the displacement amount of the toner image from the set position in the Z direction is different from the displacement amount in the –Z direction is restricted, and the distortion of the toner image is reduced. Hence, the excessive load that acts on the recording paper P when the second transfer roller 118 is urged to the counter roller 116 does not have to be largely estimated, and a required urging force decreases.

The invention is not limited to the above-described exemplary embodiments.

The transferred body is not limited to the intermediate transfer belt 106, and may be an endless photoconductor belt having a photosensitive layer. In this case, the second unit is not provided, and a toner image is directly transferred from the photoconductor belt onto recording paper P by the counter roller and the first transfer roller.

The side wall 111A and the bracket 113A may be integrated, and the side wall 111B and the bracket 113B may be integrated. Further, the housing 121 may not have the side wall 134 or 135.

The coupling portion (the fitting structure) may not have the configuration in which the stud is inserted into the through hole (the stud is detachably fitted to the through hole), and may have a configuration in which a pin is fitted to a hole.

The retract mechanism 140 separates the second transfer roller 118 from the counter roller 116 because the peripheral surface portion far from the center of the eccentric cam 149 contacts the cam follower 145. However, it is not limited thereto. The retract mechanism 140 may move the second transfer roller 118 to the counter roller 116 because the peripheral surface portion far from the center of the eccentric cam 149 contacts the cam follower 145.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device, comprising:

a first support member that supports a wound member, an endless transferred body being wound around the wound member;

a second support member that supports a transfer member, the transfer member and the wound member being configured to pinch the transferred body and a recording medium, and the transfer member being configured to cause a developer image on the transferred body to be transferred onto the recording medium;

a coupling portion that couples the second support member to the first support member so that an angle of the second support member is changeable relative to the first support member; and an urging portion that is provided at the first support member and urges the second support member in a direction in which the transfer member presses the wound member, wherein the coupling portion couples e second support member to the first support member such that the second support member is pivotable about the first support member.

2. An image forming apparatus, comprising:

an apparatus body including:

a developer image forming unit configured to form the developer image on the transferred body; and the transfer device according to claim 1, wherein the first support member is attached to the apparatus body, wherein the second support member is detachably attached to the first support member, wherein the coupling portion has a fitting structure that provides coaxial and detachable fitting at a deep side and a near side of the apparatus body along an axial direction of the transfer member, and wherein the second support member has a lift portion that contacts the apparatus body and lifts the second support member toward the first support member by a mounting operation with respect to the first support member.

3. The transfer device according to claim 1, wherein the coupling portion couples the second support member to the first support member such that the second support member is pivotable about an axis that extends substantially parallel to a rotational axis of the wound member.

4. The transfer device according to claim 3, wherein the second support member comprises:

a first stud; and a second stud that is not directly connected to the first stud, wherein the coupling portion comprises:

a first hole configured to receive the first stud; and a second hole configured to receive the second stud, and wherein the first stud and the second stud are coaxially arranged along the axis.

5. The transfer device according to claim 1, wherein the coupling portion couples the second support member to the first support member such that the second support member is pivotable about the first support member such that a rotational axis of the transfer member travels along an arced path when the second support member pivots about the first support member.

6. The transfer device according to claim 1, wherein the second support member comprises a housing that houses the transfer member.

7. The transfer device according to claim 1, wherein the transfer device is configured such that a cumulative positional assembly tolerance between the wound member and the transfer member is determined only by an assembly tolerance of the urging portion.

* * * * *